US009934763B1

(12) United States Patent
Vanacore

(10) Patent No.: US 9,934,763 B1
(45) Date of Patent: Apr. 3, 2018

(54) RESONATING SYSTEM

(71) Applicant: Robert Vanacore, Las Vegas, NV (US)

(72) Inventor: Robert Vanacore, Las Vegas, NV (US)

( * ) Notice: Subject to any disclaimer, the term of this patent is extended or adjusted under 35 U.S.C. 154(b) by 0 days.

(21) Appl. No.: 15/499,617

(22) Filed: Apr. 27, 2017

(51) Int. Cl.
*G10D 9/02* (2006.01)

(52) U.S. Cl.
CPC ..... *G10D 9/02* (2013.01); *G10D 9/023* (2013.01)

(58) Field of Classification Search
CPC ..... G10D 9/023
See application file for complete search history.

(56) References Cited

U.S. PATENT DOCUMENTS 1,419,486 A * 6/1922 Austin ..... G10B 3/08 84/350
3,618,440 A 11/1971 Ratteree
5,648,623 A 11/1997 Silverstein et al.
5,929,353 A 7/1999 Taninbaum
8,614,386 B2 12/2013 Criscuolo
D710,933 S 8/2014 Tominaga
9,218,796 B2 12/2015 Ferrando

FOREIGN PATENT DOCUMENTS

KR 20130124720 A * 11/2013 ..... G10D 7/08
WO WO2007003084 11/2007

* cited by examiner

*Primary Examiner* — Kimberly Lockett

(57) ABSTRACT

A resonating system includes a woodwind instrument that has a mouthpiece. Air is blown through the mouthpiece to play the woodwind instrument. A ligature is positioned around the mouthpiece and a reed is removably inserted into the mouthpiece. The reed vibrates when air is blown through the woodwind instrument. A resonator is provided and the resonator is removably positioned around the mouthpiece. The resonator is positioned between the ligature and the reed and the resonator is comprised of a rigid material. In this way the resonator enhances the vibration of the reed thereby enhancing a volume and clarity of an audible sound produced by the woodwind instrument.

4 Claims, 3 Drawing Sheets

RESONATING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to resonator devices and more particularly pertains to a new resonator device for enhancing volume and clarity of a woodwind instrument.

BRIEF SUMMARY OF THE INVENTION

An embodiment of the disclosure meets the needs presented above by generally comprising a woodwind instrument that has a mouthpiece. Air is blown through the mouthpiece to play the woodwind instrument. A ligature is positioned around the mouthpiece and a reed is removably inserted into the mouthpiece. The reed vibrates when air is blown through the woodwind instrument. A resonator is provided and the resonator is removably positioned around the mouthpiece. The resonator is positioned between the ligature and the reed and the resonator is comprised of a rigid material. In this way the resonator enhances the vibration of the reed thereby enhancing a volume and clarity of an audible sound produced by the woodwind instrument.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
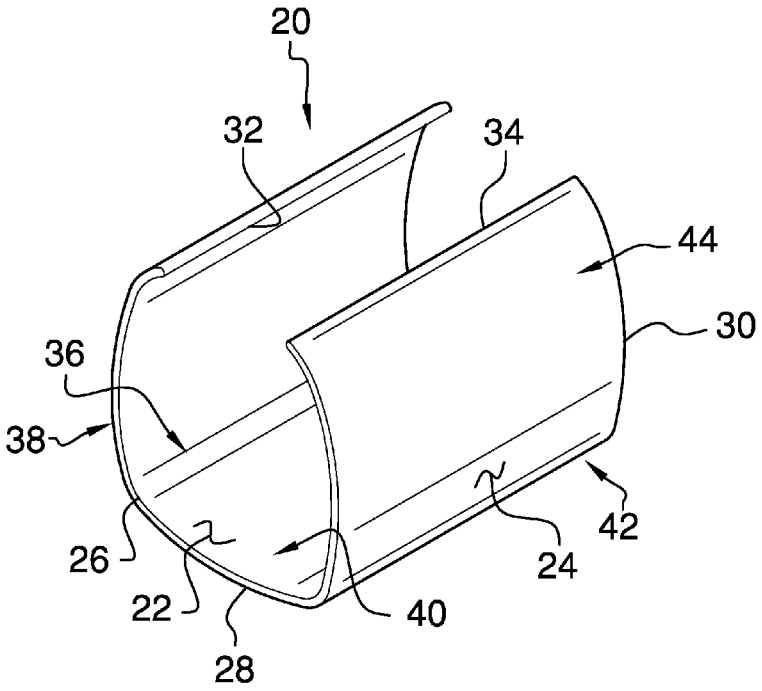
FIG. 1 is a front perspective view of a resonator of a resonating system according to an embodiment of the disclosure.
Figure 2:
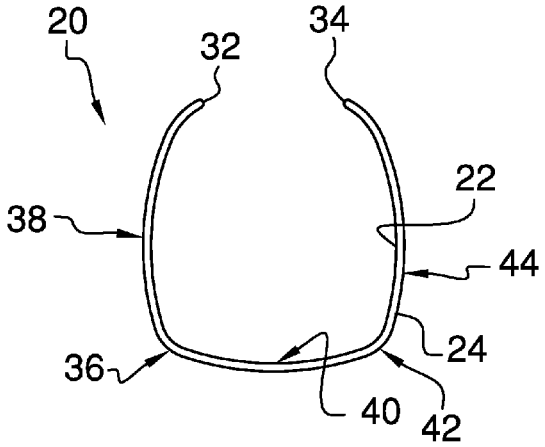
FIG. 2 is a front view of resonator of an embodiment of the disclosure.
Figure 3:
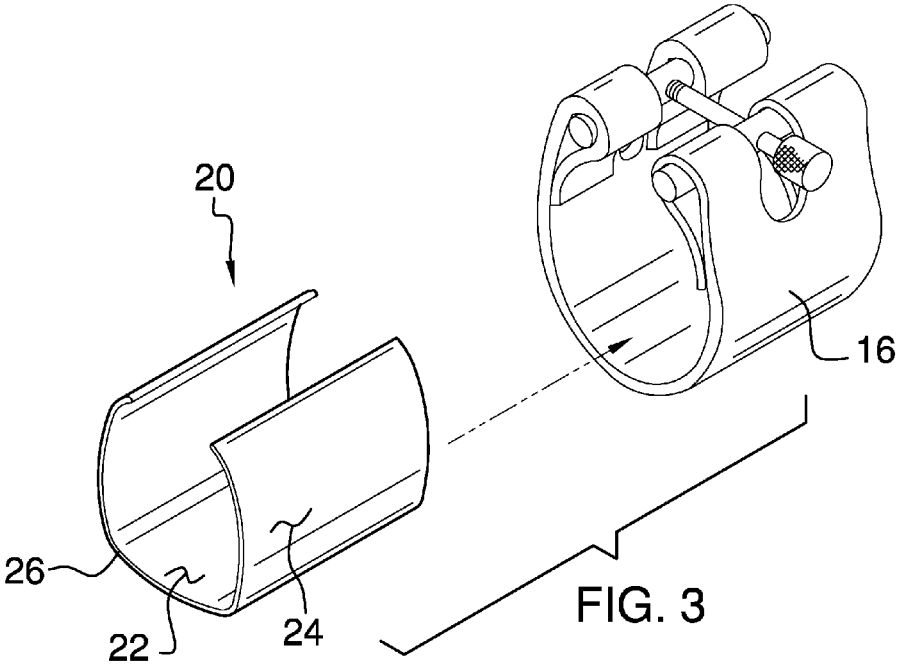
FIG. 3 is an exploded perspective view of an embodiment of the disclosure.
Figure 4:
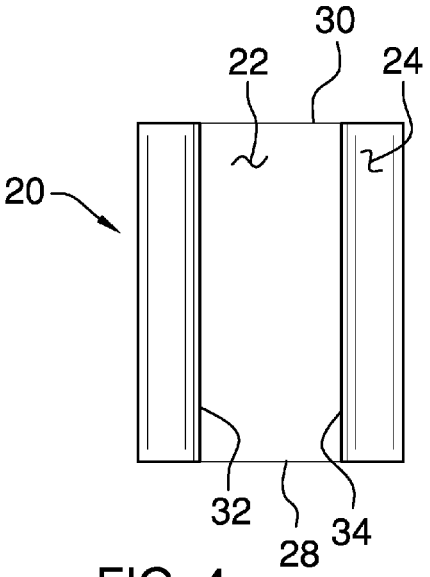
FIG. 4 is a top view of a resonator of an embodiment of the disclosure.
Figure 5:
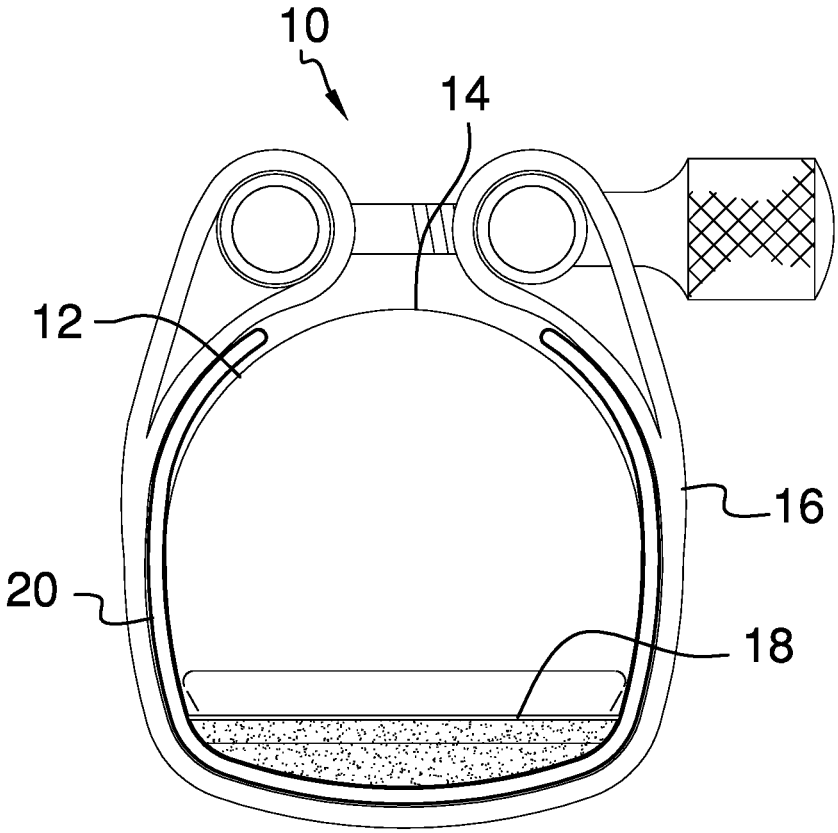
FIG. 5 is a perspective in-use view of an embodiment of the disclosure.

With reference now to the drawings, and in particular to FIGS. 1 through 5 thereof, a new resonator device embodying the principles and concepts of an embodiment of the disclosure and generally designated by the reference numeral 10 will be described.

As best illustrated in FIGS. 1 through 5, the resonating system 10 generally comprises a woodwind instrument 12 that has a mouthpiece 14. The mouthpiece 14 is selectively blown therethrough when the woodwind instrument 12 is played. A ligature 16 is provided and the ligature 16 is positioned around the mouthpiece 14. The ligature 16 may be a woodwind ligature 16 of any conventional design and the ligature 16 may be comprised of a deformable material such as leather.

A reed 18 is provided and the reed 18 is removably inserted into the mouthpiece 14. The reed 18 vibrates when the woodwind instrument 12 is blown through. The woodwind instrument 12 may be a saxophone, a clarinet and any other woodwind instrument 12 involving a reed 18. Additionally, the ligature 16 includes a clamp for tightening the ligature 16 around the reed 18 thereby retaining the reed 18 in the mouthpiece 14. The reed 18 may be a woodwind instrument reed of any conventional size and design.

A resonator 20 is provided and the resonator 20 is removably positioned around the mouthpiece 14. Moreover, the resonator 20 is positioned between the ligature 16 and the reed 18. The resonator 20 is comprised of a rigid material such as steel or the like such that the resonator 20 does not reduce the vibration of the reed 18 when the mouthpiece 14 is blown through. In this way the resonator 20 enhances the vibration of the reed 18 thereby increasing a volume and clarity of audible sounds produced by the woodwind instrument 12.

The resonator 20 has a first surface 22, a second surface 24 and a peripheral edge 26 extending therebetween. The peripheral edge 26 has a front side 28, a back side 30, a first lateral side 32 and a second lateral side 34. The resonator 20 has a first bend 36 extending between the front side 28 and the back side 30 to define a first portion 38 forming an angle with respect to a central portion 40. Additionally, the first bend 36 is positioned closer to the first lateral side 32 than the second lateral side 34.

The resonator 20 has a second bend 42 extending between the front side 28 and the back side 30 to define a second portion 44 forming an angle with respect to the central portion 40. The second bend 42 is positioned closer to the second lateral side 34 than the first lateral side 32. The first lateral side 32 is spaced from the second lateral side 34 such that the resonator 20 has a saddle shape. Additionally, each of the first portion 38 and the second portion 44 are concavely arcuate between the central portion 40 and the corresponding first 32 and second 34 lateral sides. In this way the resonator 20 conforms to a curvature of the mouthpiece 14. The reed 18 is positioned between the first surface 22 corresponding to the central portion 40 and the mouthpiece 14. Additionally, the reed 18 extends substantially between the front side 28 and the back side 30 and the ligature 16 is wrapped around the second surface 24.

In use, the reed 18 is positioned in the mouthpiece 14 and the resonator 20 is positioned around the mouthpiece 14 having the central portion 40 abutting the reed 18. The ligature 16 is wrapped around the resonator 20 and the mouthpiece 14 to retain each of the resonator 20 and the reed 18 on the mouthpiece 14. Thus, the reed 18 vibrates against the resonator 20 when mouthpiece 14 is blown through thereby enhancing the clarity and volume of the woodwind instrument 12. The resonator 20 is selectively removed from the mouthpiece 14 and the ligature 16 is wrapped around the reed 18 and the mouthpiece 14. In this way the deformable quality of the ligature 16 reduces the vibration of the reed 18 when the mouthpiece 14 is blown through. Thus, the volume of the woodwind instrument 12 is reduced compared to the volume of the woodwind instrument 12 when the resonator 20 is employed.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A resonating system for enhancing audible sounds produced by a woodwind instrument, said system comprising:

a woodwind instrument having a mouthpiece being configured to have air blown therethrough;

a ligature being positioned around said mouthpiece;

a reed being removably inserted into said mouthpiece wherein said reed is configured to vibrate when said woodwind instrument is blown through; and a resonator being removably positioned around said mouthpiece, said resonator being positioned between said ligature and said reed, said resonator being comprised of a rigid material wherein said resonator is configured to enhance the vibration of said reed, said resonator enhancing a volume and clarity of an audible sound produced by said woodwind instrument, wherein said resonator has a first surface, a second surface and a peripheral edge extending therebetween, said peripheral edge having a front side, a back side, a first lateral side and a second lateral side, wherein said resonator has a first bend extending between said front side and said back side to define a first portion forming an angle with respect to a central portion, said first bend being positioned closer to said first lateral side than said second lateral side.

2. A resonating system for enhancing audible sounds produced by a woodwind instrument, said system comprising:

a woodwind instrument having a mouthpiece being configured to have air blown therethrough;

a ligature being positioned around said mouthpiece;

a reed being removably inserted into said mouthpiece wherein said reed is configured to vibrate when said woodwind instrument is blown through; and a resonator being removably positioned around said mouthpiece, said resonator being positioned between said ligature and said reed, said resonator being comprised of a rigid material wherein said resonator is configured to enhance the vibration of said reed, said resonator enhancing a volume and clarity of an audible sound produced by said woodwind instrument, wherein said resonator has a first surface, a second surface and a peripheral edge extending therebetween, said peripheral edge having a front side, a back side, a first lateral side and a second lateral side, wherein said resonator has a second bend extending between said front side and said back side to define a second portion forming an angle with respect to said central portion, said second bend being positioned closer to said second lateral side than said first lateral side, said first lateral side being spaced from said second lateral side.

3. The system according to claim 1, wherein said reed is positioned between said first surface corresponding to said central portion and said mouthpiece having said reed extending substantially between said front end and said back end, said ligature being wrapped around said second surface.

4. A resonating system for enhancing audible sounds produced by a woodwind instrument, said system comprising:

a woodwind instrument having a mouthpiece being configured to have air blown therethrough;

a ligature being positioned around said mouthpiece;

a reed being removably inserted into said mouthpiece wherein said reed is configured to vibrate when said woodwind instrument is blown through; and a resonator being removably positioned around said mouthpiece, said resonator being positioned between said ligature and said reed, said resonator being comprised of a rigid material wherein said resonator is configured to enhance the vibration of said reed, said resonator enhancing a volume and clarity of an audible sound produced by said woodwind instrument, said resonator having a first surface, a second surface and a peripheral edge extending therebetween, said peripheral edge having a front side, a back side, a first lateral side and a second lateral side, said resonator having a first bend extending between said front side and said back side to define a first portion forming an angle with respect to a central portion, said first bend being positioned closer to said first lateral side than said second lateral side, said resonator having a second bend extending between said front side and said back side to define a second portion forming an angle with respect to said central portion, said second bend being positioned closer to said second lateral side than said first lateral side, said first lateral side being spaced from said second lateral side, said reed being positioned between said first surface corresponding to said central portion and said mouthpiece having said reed extending substantially between said front end and said back end, said ligature being wrapped around said second surface.

* * * * *